US008418847B2

(12) United States Patent
Stuckey

(10) Patent No.: US 8,418,847 B2
(45) Date of Patent: Apr. 16, 2013

(54) ENHANCING THE VISUAL APPEAL OF A CIGARETTE PACKAGE

(75) Inventor: Brian Roger Stuckey, Ithaca, NY (US)

(73) Assignee: AOI Marketing, Inc., Minneapolis, MN (US)

( * ) Notice: Subject to any disclaimer, the term of this patent is extended or adjusted under 35 U.S.C. 154(b) by 0 days.

(21) Appl. No.: 13/186,727

(22) Filed: Jul. 20, 2011

(65) Prior Publication Data

US 2013/0020213 A1 Jan. 24, 2013

(51) Int. Cl.
*B65D 85/10* (2006.01)

(52) U.S. Cl.
USPC ..... 206/270; 206/259; 206/264; 206/459.1

(58) Field of Classification Search ..... 206/242, 206/259, 264, 268, 273, 459.1, 459.5; 229/125.125, 229/160.1
See application file for complete search history.

(56) References Cited

U.S. PATENT DOCUMENTS

| | | | | | |
|---|---|---|---|---|---|
| 2,279,614 | A * | 4/1942 | Bryant | 206/259 |
| 3,083,820 | A * | 4/1963 | Roberts | 206/264 |
| 4,240,548 | A * | 12/1980 | Stio | 206/250 |
| 4,497,401 | A * | 2/1985 | Ackerman | 206/259 |
| 4,586,605 | A * | 5/1986 | Newsome | 206/267 |
| 5,366,102 | A * | 11/1994 | Bergner et al. | 206/459.5 |
| 5,871,096 | A | 2/1999 | Yakich | |
| 7,392,899 | B2 * | 7/2008 | Pham | 206/264 |
| 7,617,930 | B2 * | 11/2009 | Jones et al. | 206/256 |
| 8,066,186 | B2 * | 11/2011 | Kidwell | 206/216 |
| 2009/0301921 | A1 | 12/2009 | Kidwell | |

* cited by examiner

*Primary Examiner* — Bryon Gehman
(74) *Attorney, Agent, or Firm* — Roy W. Truelson

(57) ABSTRACT

The warning graphic portions of a cigarette package are obscured and replaced with a more visually appealing replacement graphic, while leaving the cigarette brand logo unobscured. Preferably, the cigarette package is inserted into a sleeve which obscures the warning graphic while leaving the brand logo substantially unobscured. The sleeve contains a replacement graphic in place of the warning graphic. The replacement graphic could include user self expression or advertising. The use of advertising opens a new outlet for advertisers' messages.

2 Claims, 8 Drawing Sheets

ENHANCING THE VISUAL APPEAL OF A CIGARETTE PACKAGE

FIELD OF THE INVENTION

The present invention relates to cigarette package use, and in particular to methods and apparatus which obscure visually unappealing portions of a cigarette package and replace them with advertising, personal expression, and the like.

BACKGROUND OF THE INVENTION

Recently, the Food and Drug Administration (FDA) has proposed regulations requiring the placement of a warning graphic on all cigarette packages sold in the United States. Such a warning graphic would include an image depicting some aspect of deleterious health effects associated with long-term cigarette use. The warning graphic would occupy approximately the upper one-half of each of the two major faces (front and back) of each cigarette package. In other words, it would occupy approximately one-half of the package area typically used for display of the cigarette maker's brand logo. The brand logo would accordingly be compressed and moved to the bottom half of the front and back faces of the package.

The image used in the warning graphic it intended to be visually unappealing and to evoke a negative emotional response. It is thought that the prominent display of such an image on the cigarette package at the time of sale will more effectively apprise potential users of the risks of smoking, and therefore discourage use. Whether or not it will in fact have this intended effect, it is reasonable to assume that most users would find these images disturbing, would prefer not to look at these images, and would not like to be frequently displaying them to others.

It is possible for a cigarette user to conceal the cigarette package in a pocket, purse, or the like, or to transfer the cigarettes to a cigarette case, and thus reduce or avoid displaying the warning graphic. However, this may be inconvenient as it may involve some changes in the user's behavior. Additionally, many cigarette users exhibit strong brand loyalty. The brand of cigarette a user smokes becomes part of that user's personal identity and expression, to the point where the user not only would not wish to conceal the brand, but enjoys exhibiting it in any of various ways.

An unrecognized need exists for some means of concealing the warning graphic without significantly altering user behavior and/or without simultaneously concealing the cigarette brand. Additionally, an unrecognized opportunity exists to replace the space occupied by a warning graphic with something else, particularly commercial advertising.

SUMMARY OF THE INVENTION

In accordance with the present invention, the warning graphic portions of a cigarette package are obscured are replaced with a more visually appealing replacement graphic, while leaving the cigarette maker's brand logo unobscured.

In one embodiment, a sleeve is provided which closely conforms to the contours of a cigarette package. The cigarette package is inserted in the sleeve in such a manner as to substantially obscure the warning graphic while leaving the brand logo substantially unobscured. The sleeve contains at least one replacement graphic which occupies the surface area over the warning graphic. Such a sleeve might be of a uniform opaque material which covers only the upper portion of the cigarette package. Alternatively, such a sleeve might be of a uniform transparent material which covers the entire package, upon which an opaque replacement graphic is printed on the upper half to obscure and replace the warning graphic. Alternatively, such a sleeve might be constructed of multiple materials including opaque portions an transparent portions. A sleeve may be intended for one-time, disposable use, or may be intended to be reused many times.

In an alternative embodiment, a replacement graphic printed on a surface of a thin, flat material is affixed to the cigarette package with an adhesive to obscure the warning graphic while leaving the bottom half of the package (i.e., the brand logo) unobscured.

In a further alternative embodiment, a replacement graphic is printed directly on the surface of a cigarette package over the warning graphic, while leaving the bottom half of the package unobscured.

The replacement graphic could be anything the user might find more visually appealing than the warning graphic. In particular, in one embodiment the replacement graphic could be commercial advertising. Alternatively, a replacement graphic might be any of a graphic associated with a profession, hobby, or other personal interest of the user, a user's name or monogram, coat of arms, or similar personal or family identifier, a zodiac sign, an animal, an object of beauty such as a landscape, flower(s), or beautiful woman, an American flag, a slogan or quotation, or anything else that might appeal to the user.

In a particular aspect in which the replacement graphic comprises commercial advertising, a new and heretofore unknown advertising method is provided. An advertiser could, for example, provide very large numbers of inexpensive disposable sleeves to cigarette users, who would be willing to use them simply to obscure the unappealing warning graphic. The users in turn carry and display the cigarette packages with the advertisements, providing wide dissemination of the advertiser's message.

The details of the present invention, both as to its structure and operation, can best be understood in reference to the accompanying drawings, in which like reference numerals refer to like parts, and in which:

DETAILED DESCRIPTION OF THE PREFERRED EMBODIMENTS

In the preferred embodiment, a sleeve is provided to conceal the warning graphic on a cigarette package without obscuring the cigarette brand logo. As used herein, a sleeve is a thin material forming an interior cavity of rectangular cross section which closely conforms to the external contours of a cigarette package, and which is open or openable at at least one end for insertion of the cigarette package into the interior of the sleeve. The sleeve may in fact be closed at one end and have a hinged lid at the other, so that it may become a fully closed container. The sleeve's interior cavity "closely conforms" to the external contours of the cigarette package, meaning that it is sufficiently large to insert the package, but no more than slightly larger, and not large enough to allow tumbling or substantial movement of the package within the sleeve. The dimensions of the sleeve may be such as to cause a mild drag when the package is inserted, but need not be, particularly where a hinged lid is used to restrain the package.

Figure 1A:
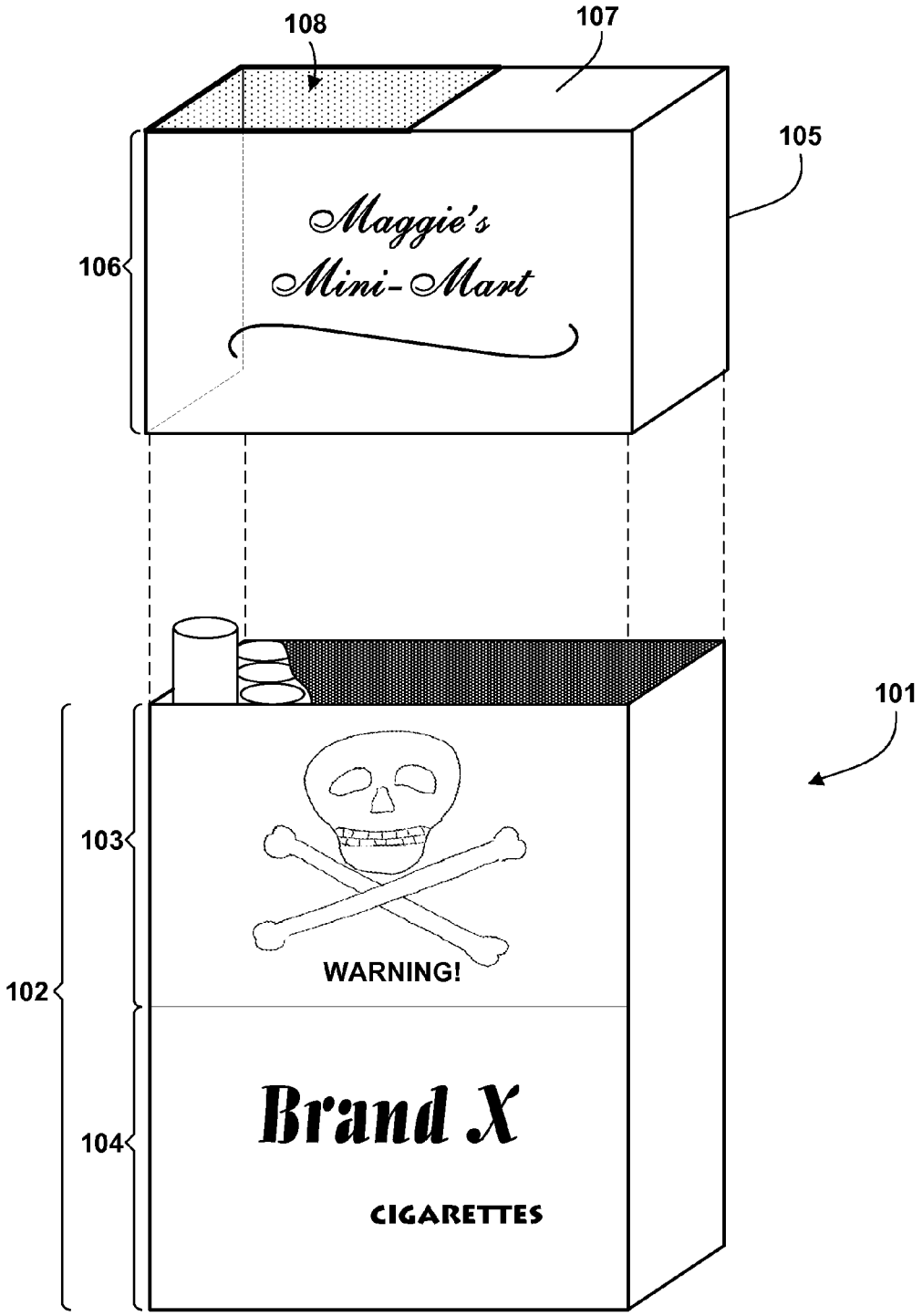
FIGS. 1A and 1B are an isometric representation of a cigarette package and a sleeve for enhancing the visual appeal of a cigarette package, according to an embodiment of the present invention.
Figure 1B:
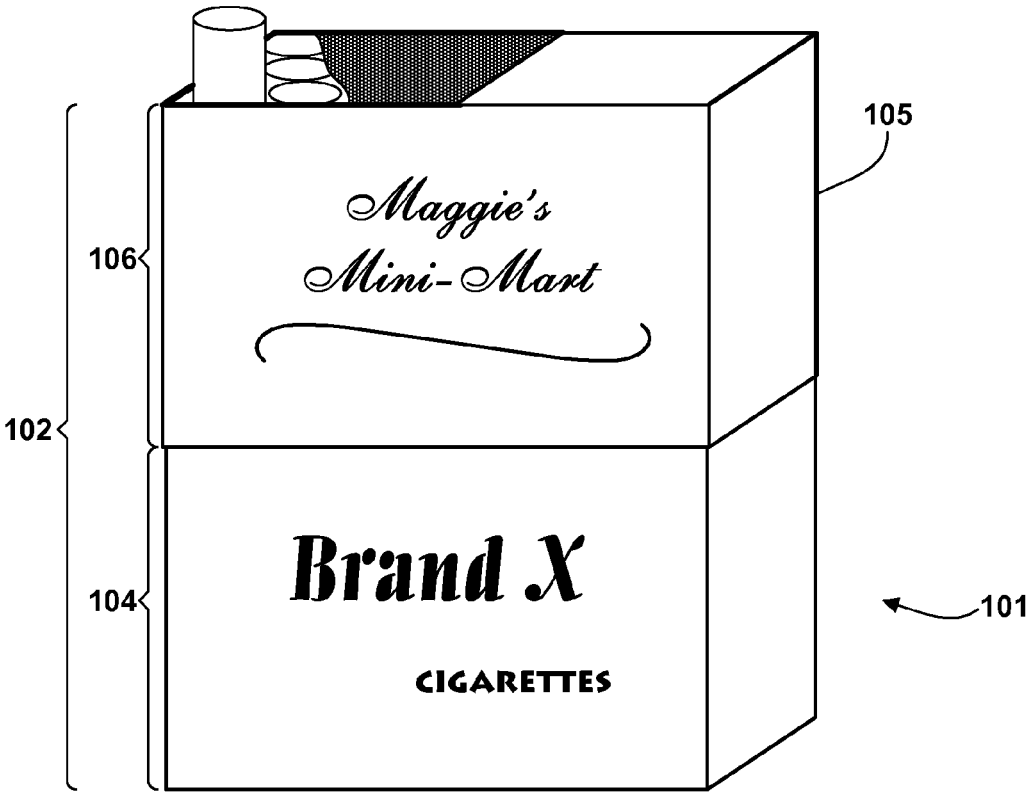

Referring to the Drawing, wherein like numbers denote like parts throughout the several views, FIGS. 1A and 1B represent a cigarette package 101 and a sleeve 105 for enhancing the visual appeal of a cigarette package, according to an embodiment of the present invention.

FIG. 1A shows cigarette package 101 before a sleeve is fitted thereto. Cigarette package 101 contains a front face 102 and a rear face (not shown). In accordance with proposed FDA regulations, a warning graphic 103 is placed on the upper half of the front face 102 of cigarette package 101. A similar warning graphic is placed on the upper half of the rear face. Warning graphic 103 could be any of various warning graphics approved by the FDA or any successor authority. FIG. 1A depicts the warning graphic as a "skull and crossbones" for illustrative purposes, although in fact such a warning graphic is not among those included in the current FDA proposal. Warning graphic 103 could be a warning graphic required by the currently proposed regulations or any subsequent or amended regulations, as well as any other applicable law, or could be a voluntary or semi-voluntary warning graphic pursuant to a consent decree, trade association agreement, or any other arrangement whereby a warning graphic is included on cigarette packages. Furthermore, while current proposed regulations require that the warning graphic be placed in the upper half of the front and rear faces, and the present description and drawing describe and illustrate the warning placed accordingly, future regulation or practice may place it in other portions of the cigarette package, and it will be understood that the design and arrangement of a sleeve or other device for enhancing the visual appeal of a cigarette package according to the present invention could be modified to cover a warning graphic on some other portion of the front and rear faces, or on other faces, or occupying all of one or more faces of the package.

The FDA regulations do not require any particular graphic on the bottom half of the front face 102 and rear face of the cigarette package. It is expected that a cigarette maker's brand logo 104 will occupy the bottom half of the front and rear faces.

It can be expected that many cigarette users will find warning graphic 103 unpleasant to look at. Indeed, the warning graphic is intended to be unpleasant to look at. While the FDA may have legal authority to require that such a warning graphic be visible on the cigarette package at the time of sale (there is currently some controversy about this issue), there is no requirement that the user look at the warning some minimum number of times, or at all. Upon purchasing a package of cigarettes, a user is free to do with it as s/he pleases, and to look at the warning or not look at the warning. A user can hide the package in a pocket, purse, or some other place so that the warning is not visible, or could even transfer the cigarettes to a cigarette case or other container so that the warning graphic would not be exhibited every time the user reached for a cigarette.

At the same time, it is well known that cigarette users exhibit strong brand loyalty, and that the brand of cigarette a user smokes becomes part of that user's personal identity and expression. Many users not only would not wish to conceal the brand of cigarette they smoke, but actually enjoy exhibiting it in any of various ways.

In order to conceal the warning graphic 103 without obscuring brand logo 104, a sleeve is provided. The sleeve 105 illustrated in FIGS. 1A and 1B is open at its bottom end for insertion, it being understood that a sleeve could also or alternatively be open at the top end. Sleeve 105 is partially closed at the top to provide a partial top surface 107 which acts as a stop when the cigarette package is inserted, and maintains the sleeve in the proper position. An opening 108 in the top surface of sleeve 105 permits access to cigarettes within cigarette package 101, without the necessity of removing the sleeve.

The user inserts cigarette package 101 into sleeve 105 along the dashed lines shown in FIG. 1A. The resultant cigarette package inserted into sleeve 105 is shown in FIG. 1B. The length of sleeve 105 in the direction of insertion is approximately one-half the length of cigarette package 101 in the same dimension. As a result, when cigarette package 101 is fully inserted into sleeve 105, warning graphic 103 is obscured by sleeve 105, while the brand logo 104 remains visible, as shown in FIG. 1B.

The front and rear faces of sleeve 105 which cover the warning graphics create a new opportunity for self-expression and/or advertising. A replacement graphic 106 is placed on the front face of sleeve 105. Preferably, a second replacement graphic (not shown) is placed on the rear face of the sleeve. This second replacement graphic could be the same as the first, or could be different. Although it is preferred to place a replacement graphic on both front and rear faces of the sleeve, it would alternatively be possible to place it only on one face. The use of the word "graphic" is not meant to imply that the replacement graphic contains no text or contains something other than text; a replacement graphic could be only an image, or an image accompanied by text, or only text, in a plain or a fanciful font. Furthermore, the use of the word "graphic" is not meant to imply that the replacement graphic is on a uniformly flat surface; the replacement graphic may be etched or sculpted in relief to be three-dimensional.

The replacement graphic could contain anything which the user might wish to place on the cigarette package. The replacement graphic might be any of various forms of user self-expression. By way of example and not limitation, a replacement graphic might contain a symbol or image associated with a profession, hobby, or other personal interest of the user, a user's name or monogram, a coat of arms or similar personal or family identifier, a zodiac sign, an animal (either real or mythical, such as a unicorn or dragon), an object of beauty such as a landscape, flower(s), or beautiful woman, an American flag, a slogan or quotation, etc.

In one embodiment, the replacement graphic comprises commercial advertising. A method or device which conceals the warning graphic opens a previously unavailable opportunity for advertising in the space occupied by the concealed warning graphic. Although each individual cigarette package provides only a small area, this space is potentially valuable advertising space. Each cigarette user carries the package from place to place, often displaying it for friends and others to see. Due to the personal nature of the user's cigarette package, a commercial advertisement thereon carries an implicit endorsement by the user, in effect implying that the cigarette user also uses and endorses the advertised product or service, in the same way that the cigarette maker's logo on the package becomes an advertisement and endorsement of the cigarette brand.

The product or service advertised on the replacement graphic could be anything that might be advertised. In the example of FIG. 1A, a fictitious "Maggie's Mini-Mart" is advertised, implying a retail store where cigarettes may be purchased. However, such an advertisement need not be a retail outlet where cigarettes may be purchased, and need not have any relation to cigarettes or the cigarette brand. By way of example and not limitation, such advertising might include any of: professional sports teams, alcoholic and non-alcoholic beverages, snack foods or other foods, restaurants and taverns, motor vehicles and motor vehicle services, personal care products and services, recreational and athletic products, home repair and remodeling services, real estate services, insurance services, travel services, legal services, educational and self-help services, and so forth. The list of potential advertised products or services is almost endless.

Where the replacement graphic contains commercial advertising, it is possible that the advertiser will bear the cost of manufacturing and distributing the sleeve or other device bearing or affixing the replacement graphic, and will provide the same to the user gratis in order to encourage widespread dissemination of the advertiser's message. However, this need not be the case, and the advertiser may alternatively charge the user for use of the sleeve or other device bearing or affixing the replacement graphic. It is well known that, in selective cases, people will pay for the privilege of advertising other's products or services, and some enterprises have generated significant revenue by selling or licensing for sale various articles unrelated to their business which contain trademarks owned by the respective enterprises. Examples of such trademarks include those of professional sports teams, trademarks of motion picture studios, BUDWEISER™ beer, HARLEY-DAVIDSON™ motorcycles, COCA-COLA™ soft drinks, and so forth. Thus, for the advertiser, a sleeve or other device bearing or affixing the replacement graphic may become an independent source of revenue, apart from any revenue generated as a result of increased sale of the advertised product or service.

Advertising and user self-expression need not be mutually exclusive in the replacement graphic. In order to encourage wide dissemination of the advertiser's message, an advertiser may offer a variety of different replacement graphics designed to appeal to different users. A portion of a replacement graphic may contain an advertiser's trademark and message, while some other portion contains elements of user self-expression.

Many variations in the design and construction of a sleeve are possible, provided that the warning graphic is obscured when the package is inserted into the sleeve and the cigarette brand logo remains visible on at least one surface. Several such variations are described below, it being understood that these variations are described as examples and are not intended to be limiting.

A sleeve may be provided as a disposable item for one-time use or for use with only a small number of cigarette packages, or may be provided as an item intended for long term use with many cigarette packages. For example, a disposable sleeve might be constructed of heavy paper or cardboard, formed plastic sheet, styrofoam, or some other suitable material. A paper or cardboard sleeve might be constructed having fold lines and/or flaps, so that it can be flattened for packaging a large number of sleeves in a single packaging container. Any of various suitable technique known in the art for construction of three-dimensional paper or cardboard shapes might be employed. A sleeve for long term use would typically be constructed more substantially. For example, it might be of a rigid-wall injection molded plastic or metal (stainless steel, brass, aluminum, etc.).

A sleeve may be constructed entirely of opaque material, where the cigarette brand logo is uncovered, or may be constructed of a combination of opaque and transparent materials, the transparent material being used to cover the cigarette brand logo, or may be constructed entirely of transparent material having imposed thereon printing or some other opaque layer at the location of the warning graphic, so that the warning graphic is obscured.

Figure 2A:
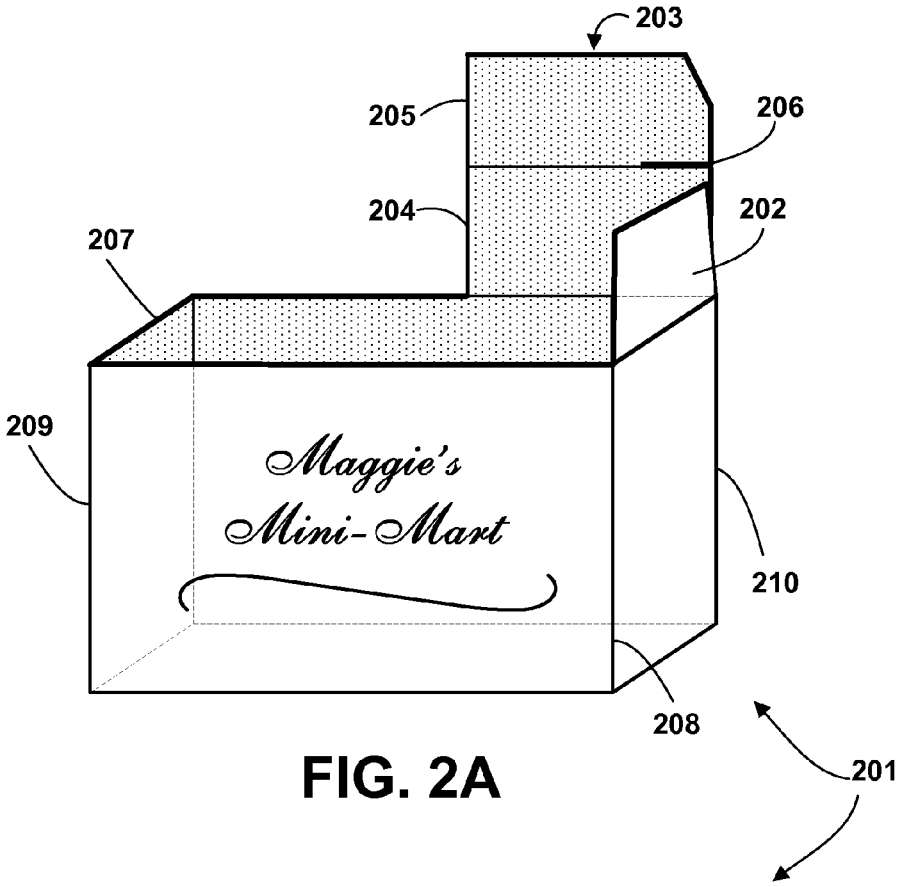
FIGS. 2A and 2B are an isometric representation of an embodiment of a flattenable version of a sleeve, FIG. 2A showing the sleeve in the extended orientation, and FIG. 2B showing the sleeve in a flattened orientation.
Figure 2B:
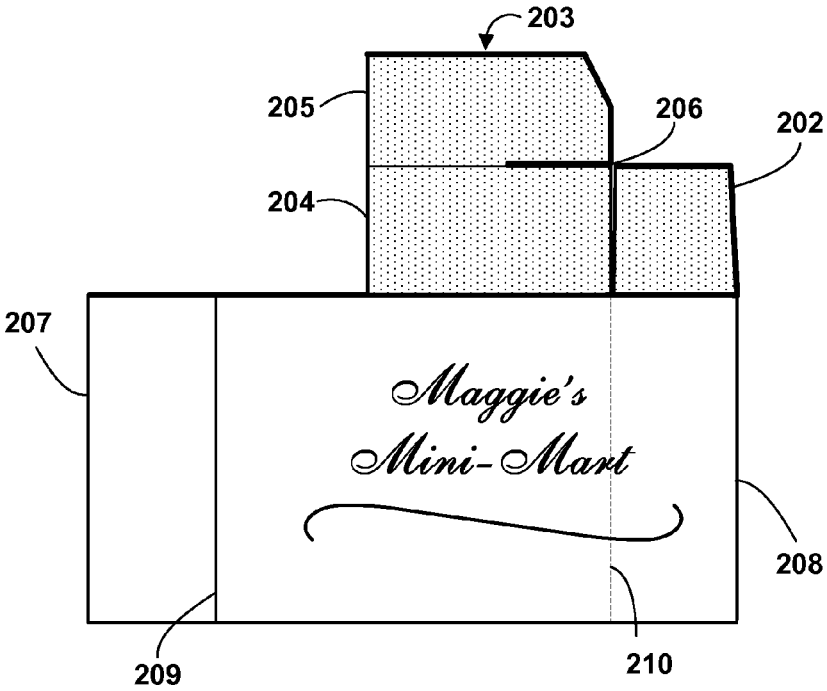

The sleeve 105 depicted in FIGS. 1A and 1B could be formed as a rigid, non-deformable member or assembly. However, it may be desirable to be able to flatten or compress the sleeve for ease of storage and shipment, particularly where a disposable sleeve is used. FIGS. 2A and 2B are isometric representations of an embodiment of a flattenable version of a sleeve 201, similar to the sleeve shown in FIGS. 1A and 1B. Such a sleeve is preferably constructed of stiff paper or cardboard, although it could also be thin plastic or other materials. FIG. 2A shows sleeve 201 in the extended orientation, while FIG. 2B shows the sleeve in a flattened orientation. Referring to FIG. 2A, a pair of flaps 202, 203 are used to form the partial top surface of sleeve 201. Flap 202, along a narrow face of the sleeve, is first folded inward along the fold line. Flap 203 is then folded over flap 202, with upper portion 205 of flap 203 being inserted into the interior of the sleeve, and lower portion 204 of flap 203 lying directly over and covering folded flap 202 to form the partial top surface. Locking groove 206 running along the fold line between flap portions 204 and 205 causes flap portion 205 to engage flap 202 and hold the flaps in place. As will be appreciated, this construction is easily compressible by folding the sleeve at opposite edges 207, 208 and flattening the other two opposite edges 209, 210 of the sleeve to place the sleeve in a fully flattened and compressed orientation, as represented in FIG. 2B.

Figure 3A:
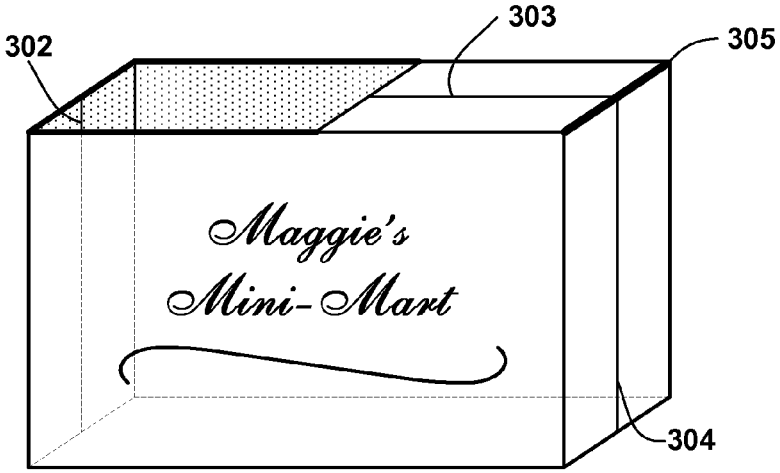
FIGS. 3A and 3B are an isometric representation of an alternative embodiment of a flattenable version of a sleeve, FIG. 3A showing the sleeve in the extended orientation, and FIG. 3B showing the sleeve in a flattened orientation.
Figure 3B:
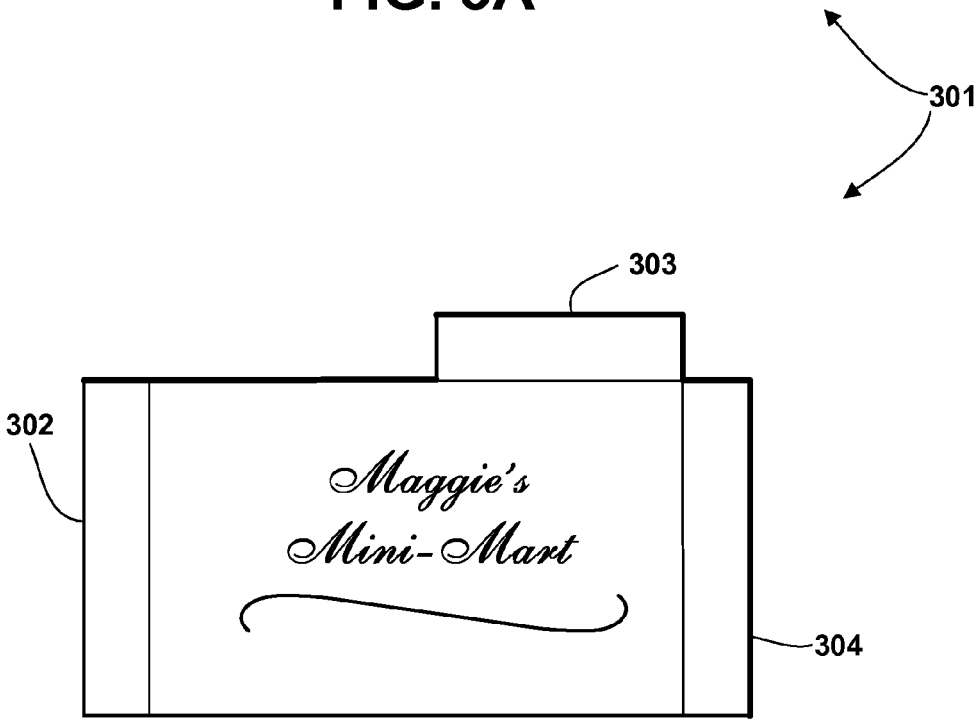

FIGS. 3A and 3B are isometric representations of an alternative embodiment of a flattenable version of sleeve 301, similar to the sleeve shown in FIGS. 1A and 1B, which could also be of stiff paper, cardboard, or other flat, foldable materials. FIG. 3A shows sleeve 301 in the extended orientation, while FIG. 3B shows the sleeve in a flattened orientation. Referring to FIG. 3A, a set of fold lines 302-304 in the narrow side and partial top faces of the sleeve run parallel to and approximately equidistant from the edges. Top edge 305 is cut, so that the adjoining narrow faces can fold independently. The sleeve is compressed by folding the narrow faces along fold lines 302-304 and flattening the edges at the front and rear faces. The resultant compressed orientation is represented in FIG. 2B, the fold lines now constituting the outer edges of the compressed sleeve, as shown.

In the embodiment shown in FIGS. 1A and 1B, sleeve 105 contains a partial top surface 107 to act as a stop and hold the sleeve in correct position. It would alternatively be possible to omit partial top surface 107, leaving the entire top open. In this case, the sleeve should fit sufficiently snugly over the cigarette package to hold it in position. As a further alternative, a full top surface which is hinged could be provided, so that access to the cigarettes can be obtained by opening the hinged surface. The hinge axis may be along a top edge of the sleeve, or may be below the top edge to provide a hinged lid which matches those commonly found on certain cigarette packages. As used herein, "hinged" refers to the ability to rotate a member to an open or closed position, and does not necessarily require the use of hinges in the form of separate mechanical members. A "hinged" surface could be one which is attached with one or more mechanical hinges, or could be constructed of an integrally formed material (such as paper) which is bent along a bending axis.

In the embodiment shown in FIGS. 1A and 1B, the length of sleeve 105 in the direction of insertion is approximately one-half the length of the cigarette package in the same dimension, so that only the top half of the cigarette package is inserted into the sleeve 105. However, a sleeve could alternatively be of approximately the same dimensions as the package and large enough to contain the entire package, provided that the cigarette maker's brand logo on at least one surface of the bottom half of the package remains visible. This could be accomplished either by use of transparent materials in the sleeve, or by leaving an opening in the sleeve which leaves the brand logo substantially exposed.

In the embodiment shown in FIGS. 1A and 1B, the bottom of the sleeve is open, allowing the cigarette package to be inserted from the bottom. However, in the case where the sleeve is of approximately the same dimensions as the package as described above, the bottom surface of the sleeve could be closed. Such a closed surface might be hinged, allowing the surface to be opened for insertion of the cigarette package, or might be fixed, so that the cigarette package is inserted from the top of the sleeve.

In the embodiment shown in FIGS. 1A and 1B and in certain others shown and described herein, the sleeve forms a hollow rectangular parallelopiped, all of the faces of the sleeve being rectangles. However, the sleeve faces need not be rectangles, and could alternatively be trapezoidal, or beveled to form a pentagon, or any number of shapes which are curved along one or more edges for aesthetic effect.

In the embodiment shown in FIGS. 1A and 1B and in certain others shown and described herein, the sleeve is designed so that cigarettes can be accessed without removing the cigarette package from the sleeve. However, in an alternative embodiment it may be intended that the package be fully or partially withdrawn from the sleeve in order to access the cigarettes.

Figure 4:
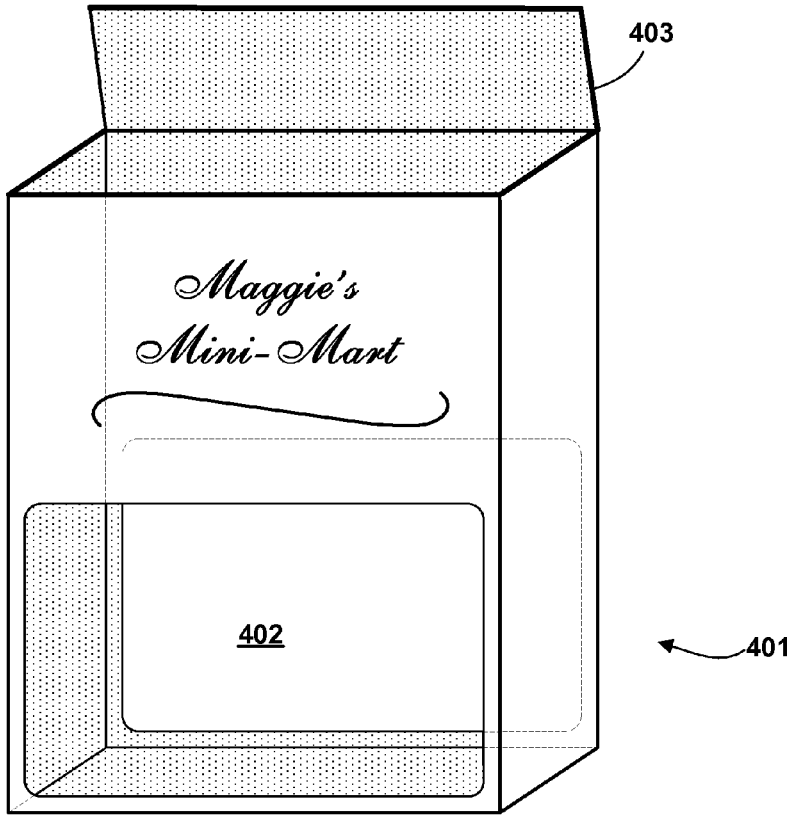
FIG. 4 is an isometric representation of an alternative embodiment of a sleeve which incorporates certain design variations.

FIG. 4 is an isometric representation of an alternative embodiment of a sleeve which incorporates some of the variations described above. Referring to FIG. 4, alternative sleeve 401 is constructed of an opaque material, and defines an interior space which is approximately the same size as the cigarette package. Specifically, the length of sleeve 401 in a dimension parallel to the direction of cigarette package insertion is approximately the same (and preferably just slightly larger than) that of the cigarette package. Sleeve 401 is closed at the bottom, so that the cigarette package is inserted from the top. In the embodiment represented in FIG. 4, sleeve 401 contains a hinged top surface 403, which can be opened for insertion of the cigarette package and for access to cigarettes. The sleeve could alternatively be completely open at the top for insertion of the package and access to cigarettes, or could have a hinged partial top surface, which is opened for insertion of the cigarette package, but need not be opened for access to cigarettes. The hinged top surface may be formed of a sheet-like member which is integral with the rear surface and which is folded along a fold line where the rear and top surfaces meet. For example, the sleeve could be constructed of paper, which is folded at the top edge. Such a paper sleeve could additionally be folded along the sides at fold lines (not shown) to compress the sleeve for storage and shipment, similar to well-known paper grocery bags. Alternatively, the top surface may be attached with separate mechanical hinges, as would typically be the case of a non-compressible sleeve made of metal or molded plastic. Alternative sleeve 401 contains an opening 402 in the front surface at the location of the cigarette brand logo when the cigarette package is fully inserted into the sleeve, so that, when the package is inserted, the brand logo is visible through the opening. Preferably, a similar opening exists in the rear surface, although for structural reasons it would be possible to omit the opening in the rear surface. A transparent material could be used in place of the openings.

Figure 5:
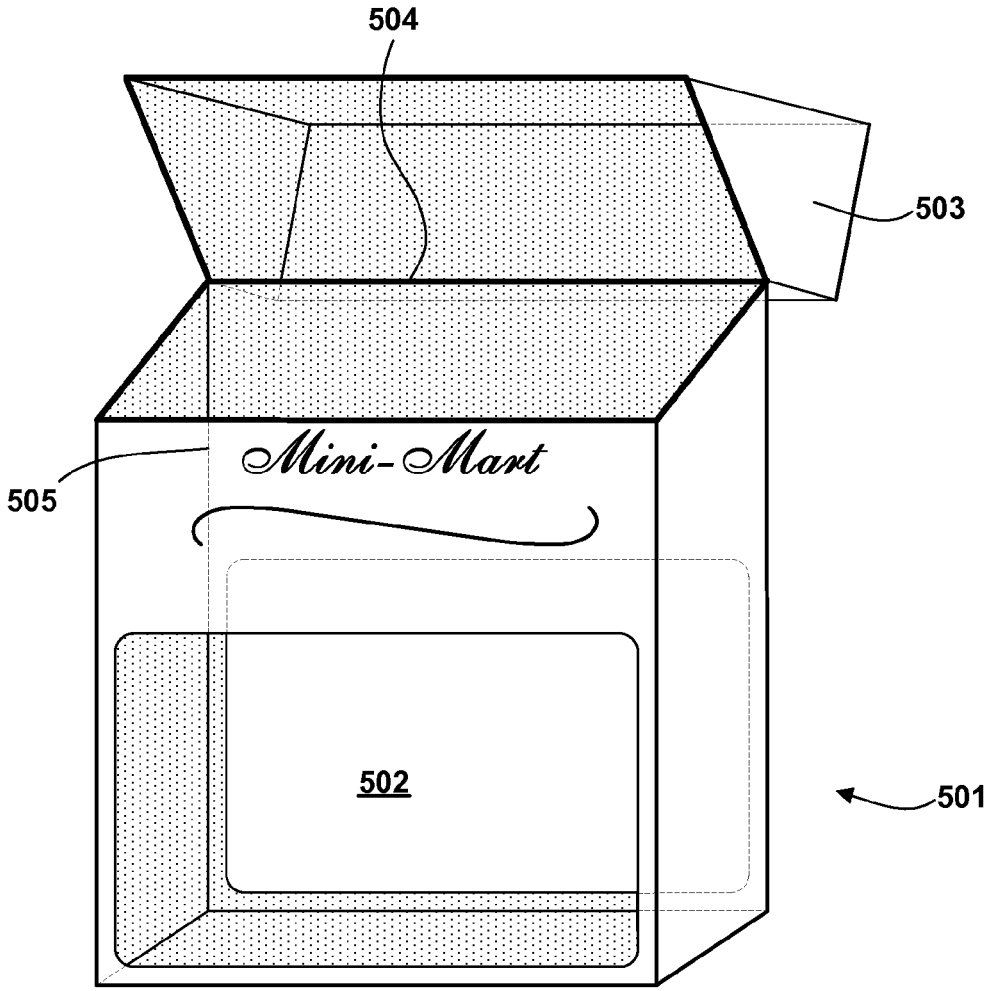
FIG. 5 is an isometric representation of a further alternative embodiment of a sleeve which incorporates a hinged lid.

FIG. 5 is an isometric representation of a further alternative embodiment of a sleeve which incorporates some of the variations described above, including in particular a hinged lid. Referring to FIG. 5, alternative sleeve 501 is constructed of an opaque material, and defines an interior space which is approximately the same size as the cigarette package. Similar to the sleeve 401 of FIG. 4, the length of sleeve 501 in a dimension parallel to the direction of cigarette package insertion is approximately the same (and preferably just slightly larger than) that of the cigarette package. Sleeve 501 is closed at the bottom, so that the cigarette package is inserted from the top. Cigarette brand logo is visible through opening 502 in the front surface. Preferably, a similar opening is in the rear surface. A hinged lid 503 rotates about a hinge axis 504, which is located parallel to and below the top edge of the rear surface of the sleeve. Lid 503 thus includes not only the top surface, but also upper portions of the front, rear and side faces. An upper portion of the replacement graphic may be on the front face of the lid (not shown), so that it joins a lower portion of the replacement graphic 505 when the lid is closed. The lid is opened both to insert a cigarette package and for access to the cigarettes inside, but otherwise typically remains closed to protect the contents. It will be appreciated that such a hinged lid may be constructed to match the dimensions of hinged lid cigarette packages.

Figure 6:
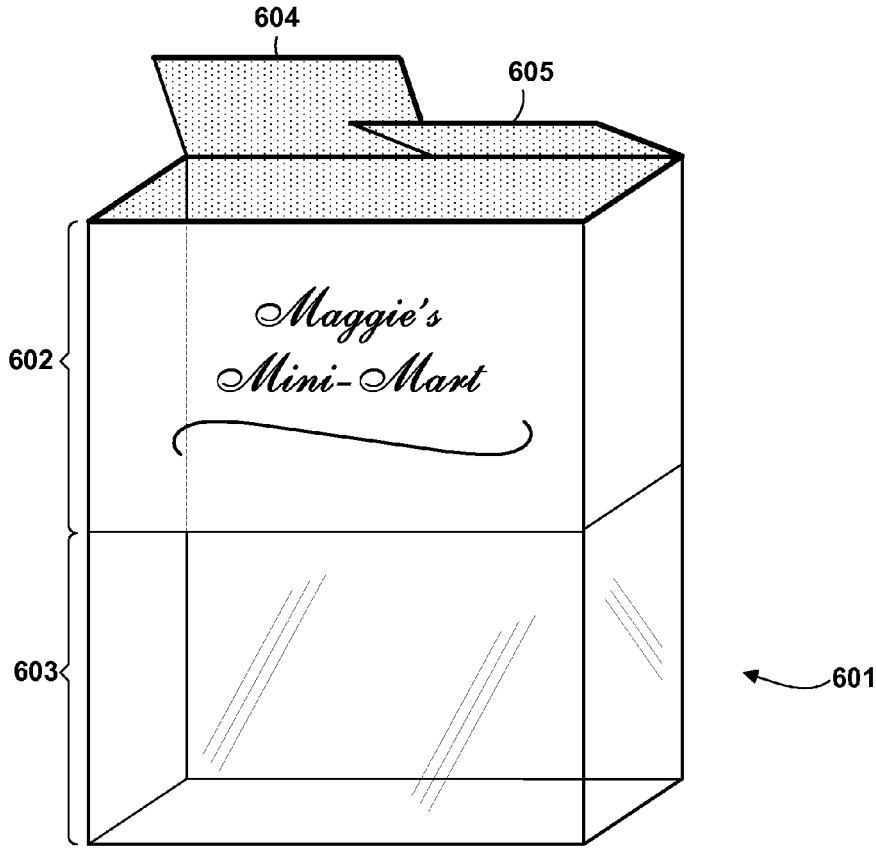
FIG. 6 is an isometric representation of a further alternative embodiment of a sleeve which incorporates a dual hinged lid and transparent bottom half.

FIG. 6 is an isometric representation of a further alternative embodiment of a sleeve 601 which incorporates some of the variations described above, including in particular a dual hinged lid and transparent lower half. Referring to FIG. 6, alternative sleeve 601 contains upper portion 602 constructed of an opaque material, and lower portion 603 constructed of a transparent material. The underlying structural material in both halves could be different, or could be the same transparent material, the upper half being coated with an opaque layer, paint, ink or the like. Like sleeves 401 and 501, sleeve 601 defines an interior space which is approximately the same size as the cigarette package, the length of sleeve 601 in a dimension parallel to the direction of cigarette package insertion being approximately the same (and preferably just slightly larger than) that of the cigarette package. Sleeve 601 is closed at the bottom, so that the cigarette package is inserted from the top. When the package is inserted into sleeve 601, the cigarette brand logo is visible through the transparent bottom half 603, while opaque upper half 602 obscures the warning graphic. A dual hinged lid is provided, including hinged portions 604 and 605, which rotate about an axis parallel to and near the top edge of the rear surface. Both lid portions 604, 605 are opened to insert the cigarette package. However, to access a cigarette, it is only necessary to open hinged lid portion 604, thus reducing the change of accidental spillage of contents when withdrawing a cigarette.

Figure 7:
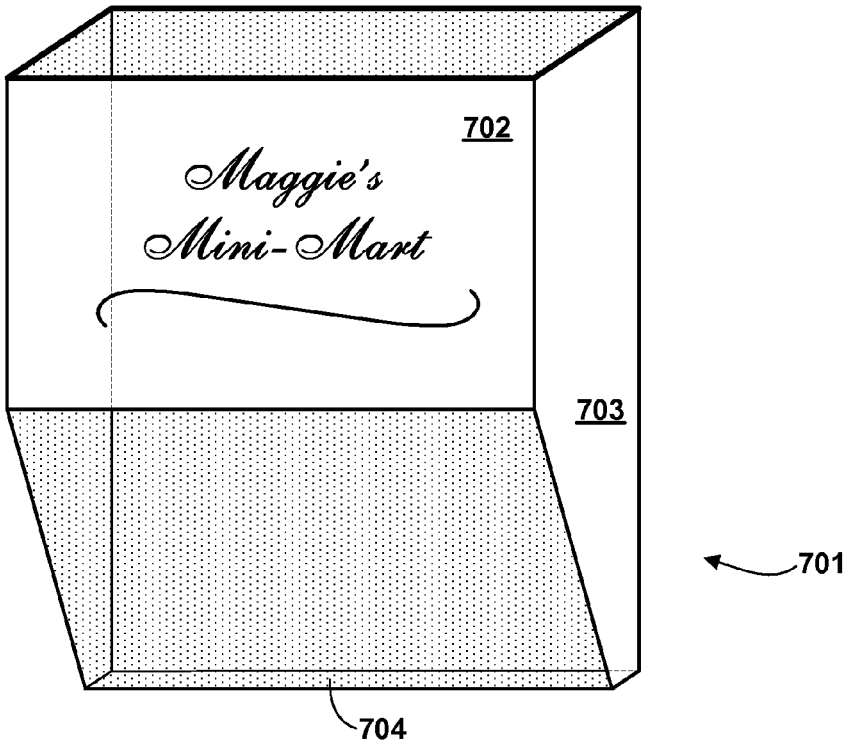
FIG. 7 is an isometric representation of a further alternative embodiment of a sleeve which incorporates beveled sides.

FIG. 7 is an isometric representation of a further alternative embodiment of a sleeve 701 which incorporates some of the variations described above, including in particular beveled side faces. Referring to FIG. 7, alternative sleeve 701 is constructed of an opaque material, and contains a short front face 702 which obscures the warning graphic on the front face of the package while leaving the cigarette brand logo exposed. Beveled sides 703 extend all the way to the bottom of the cigarette package at the rear. The rear face of the sleeve obscures the entire rear of the cigarette package. A narrow, partial bottom surface 704 acts as a stop to restrain the cigarette package and hold it in place with respect to the sleeve. The top of sleeve 701 is completely open for insertion of the cigarette package and access to cigarettes.

It will be appreciated that numerous other variations are possible in the construction of a sleeve which obscures the warning graphic while simultaneously leaving at least one cigarette brand logo substantially unobscured and visible.

In the preferred embodiment, a sleeve is provided for insertion of the cigarette package within in order to replace the warning graphic with a replacement graphic while leaving the cigarette brand logo visible. However, in certain alternative embodiments, it would be possible to accomplish the same result by other means.

In a first such alternative embodiment, the warning graphic is obscured by affixing thereto a thin, flat, opaque sheet with an adhesive, the sheet having a size corresponding to the warning graphic, and having imprinted or otherwise imposed on the visible side the replacement graphic. For example, it will be appreciated that such a replacement graphic could be printed on well known self-adhesive paper labels of appropriate size. It would be possible to place a dispensing spool or machine for such labels at a retail location where cigarettes are sold, and to allow the purchaser to apply the label upon purchase of the cigarette package. Alternatively, it may be possible to design an automated label application device, into which a purchaser inserts the cigarette package, and which automatically applies the label in the proper location.

In a second alternative embodiment, an opaque replacement graphic is printed directly on the surface of the cigarette package using a special purpose printing device, which is preferably provided at the retail sale location. Such a special purpose printing device could use any applicable printing technology, now known or hereafter developed, including in particular digital data inkjet technology, as is well known. In particular, one advantage of printing is the potential variety of replacement graphics which can be made available using modern digital data processing technology. For example, a user could select a personalized graphic, which might be combined with a message from an advertising sponsor, the advertising sponsor assuming the cost of providing the printer in exchange for the privilege of advertising.

Although a specific embodiment of the invention has been disclosed along with certain alternatives, it will be recognized by those skilled in the art that additional variations in form and detail may be made within the scope of the following claims:

What is claimed is:

1. A method of advertising, comprising:

designing a replacement graphic for use on a cigarette package, the cigarette package having a warning graphic on a first portion of a first face thereof and a cigarette brand logo on a second portion of the first face thereof, the replacement graphic corresponding in size to the warning graphic on the first face of the cigarette package, said replacement graphic containing at least one advertisement; and providing means for applying said replacement graphic over said warning graphic to a user of the cigarette package, wherein said replacement graphic is applied over said warning graphic by said means for applying said replacement graphic over said warning graphic such that the warning graphic is obscured while leaving the cigarette brand logo unobscured, and wherein said replacement graphic is applied over said warning graphic by said means for applying said replacement graphic over said warning graphic such that cigarettes within the cigarette package are accessible to be withdrawn therefrom by the user without exposing the warning graphic.

2. The method of advertising of claim 1, wherein said step of providing means for applying said replacement graphic over said warning graphic to a user of the cigarette package comprises providing a sleeve containing said replacement graphic on at least one face thereof to the user of the cigarette package, said sleeve closely conforming to the external contours of the cigarette package, wherein said sleeve is constructed such that, when the cigarette package containing the warning graphic on the first portion of the first face thereof and the cigarette brand logo on the second portion of the first face thereof is inserted into said sleeve, the sleeve obscures the warning graphic while leaving the cigarette brand logo unobscured, and wherein said replacement graphic is positioned directly over said warning graphic when the cigarette package is inserted into said sleeve.

* * * * *